United States Patent [19]

Kleen et al.

[11] 4,083,026

[45] Apr. 4, 1978

[54] ARRANGEMENT WITH INDUCTIVE VOLTAGE TRANSFORMERS

[76] Inventors: Gerhard Kleen, Burgfrauenstr. 79, 1000 Berlin 28; Heinz Schiemann, Quellweg 38, 1000 Berlin 13; Karl Allmendinger, Altonaer Str. 41, 1000 Berlin 20, all of Germany

[21] Appl. No.: 744,158

[22] Filed: Nov. 22, 1976

[30] Foreign Application Priority Data

Nov. 28, 1975 Germany ..... 2554142

[51] Int. Cl.[2] ..... H01F 15/14; H01F 27/00

[52] U.S. Cl. ..... 336/70; 336/84 R; 336/92

[58] Field of Search ..... 336/69, 70, 84, 90, 336/92, 96, 223, 105, 107, 5, 10, 12; 307/17, 83; 323/48, 49

[56] References Cited

U.S. PATENT DOCUMENTS 1,034,929 8/1912 Reynders et al. ..... 336/70

*Primary Examiner*—Thomas J. Kozma

[57] ABSTRACT

The invention is an arrangement of inductive voltage transformers for installation in a completely insulated high-voltage switching installation comprising a metal encapsulation and several high-voltage conductors. In accord with the invention each of the inductive voltage transformers includes an insulating body carrying a respective high-potential winding, and each further includes a bushing laterally joined to its respective insulating body. More particularly, in further accord with the invention the bushings are arranged so as to be continuations of the high voltage conductors of the switching installation when the transformers are disposed therein. Moreover, the remaining portions of each one of the voltage transformers are located in a respective space which is defined by the bushing forming that one voltage transformer, the bushing of the voltage transformer following that one voltage transformer in the circumferential direction, and by an area between such bushings which lies adjacent the portion of the metal encapsulation when the arrangement is disposed within such portion.

13 Claims, 4 Drawing Figures

Fig. 1
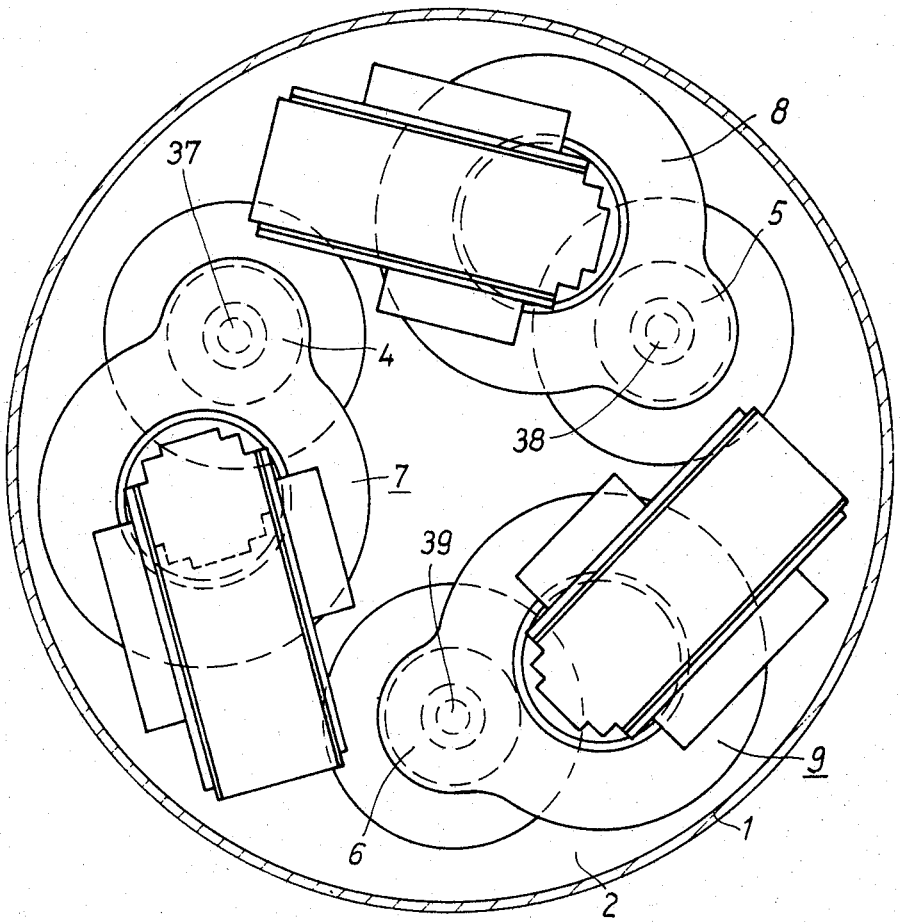
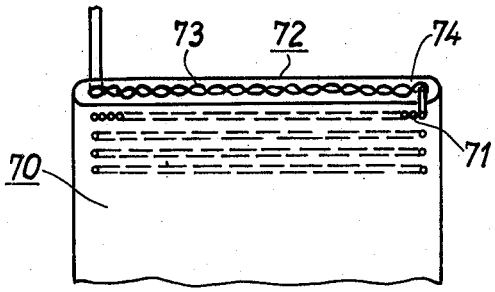
Fig. 4

ARRANGEMENT WITH INDUCTIVE VOLTAGE TRANSFORMERS

BACKGROUND OF THE INVENTION

1. Field of the Invention

The invention relates to an arrangement of inductive voltage transformers for installation in a completely insulated high-voltage switching installation comprising a metal encapsulation and several high-voltage conductors.

2. Description of the Prior Art

The manufacture of inductive voltage transformers for completely insulated high-voltage switching installations of the above-type presents no significant difficulties regarding compliance with technical requirements related to voltage measurments. However, problems do arise due to the insulation required and, in particular, due to the available space for housing the transformers, which is determined by the dimensions of the measuring capsule. Heretofore such space problems could not be adequately solved, so that only arrangements employing capacitive voltage transformers have been used to date in encapsulated high-voltage switching installations.

The capacitive voltage transformers in the aforesaid known arrangements always contain a capacitive voltage divider followed by an amplifier. The capacitive voltage divider comprises a high-potential capacitor, which includes a respective high-voltage conductor of the switching installation as one of its electrodes and a measuring electrode of large area, arranged at a distance from the high-voltage conductor, as the other of its electrode. Additionally, the voltage-divider comprises a low-potential capacitor, the latter being formed by a further, large-area electrode arranged at a distance from the measuring electrode or by a separately arranged capacitor connected to the measuring electrode.

The space problems encountered with capacitive voltage dividers or transformers can be solved without difficulty, as such transformers require only relatively thin area electrodes to be disposed in the radial direction and further require only a thin insulating layer to insulate the electrodes from the grounded metal encapsulation. However, to provide power analogous to that delivered at the secondary of an inductive voltage transformer, such capacitive voltage transformers must be followed by an amplifier, for which a supply voltage source must also be provided.

It is an object of the present invention to provide an arrangement comprised of inductive voltage transformers which can be installed in a cylindrical portion of a metal capsule of a completely insulated high-voltage switching installation without enlarging the metal capsule in the radial direction.

SUMMARY OF THE INVENTION

In accordance with the principles of the present invention, the above and other objectives are accomplished in an arrangement comprising a number of inductive voltage transformers each of which includes an insulating body carrying a respective high-potential winding, and each of which includes a bushing laterally joined to its respective insulating body. More particularly, in accord with the invention the bushings are arranged so as to be continuations of the high voltage conductors of the switching installation when the transformers are disposed therein. Moreover, the remaining portions of each one of the voltage transformers are located in a respective space which is defined by the bushing forming that one voltage transformer, the bushing of the voltage transformer following that one voltage transformer in the circumferential direction, and by an area between such bushings which lies adjacent the portion of the metal capsule when the arrangement is disposed within such portion.

With the arrangement of transformers so configured, i.e., with bushings laterally joined to their respective insulating bodies and, thus, in parallel relationship to the longitudinal axis of their respective high-potential windings and with the indicated arrangement of remaining portions of the transformers, the space in the metal capsule receiving the transformers can not be utilized optimally. This is due to the fact that the relatively far overhanging active parts of each voltage transformer are not centered around their respective high-voltage conductor or their respective bushing. Instead they are disposed eccentrically thereto and, in the installation, are rotated into the space defined by the respective bushing, the bushing of the voltage transformer following in the circumferential direction, and the area therebetween adjoining the portion of the metal capsule. As a result, the space between the high-voltage conductors or the bushings and the metal capsule is not needed for accommodating the active parts of the voltage transformers and, therefore, an enlargement of the metal capsule is not necessary, as would be the case with an arrangement of such active parts concentric with the high-voltage conductors. Moreover, it is not possible to associate an inductive voltage transformer with each high-voltage conductor of the high-voltage switching installation without enlarging the metal capsule, and to accommodate the individual voltage transformers in one plane transversely to the longitudinal direction of the metal capsule. Therefore, no additional space is needed in the axial direction of the metal capsule as well, employing the arrangement of the present invention.

It is an advantage of the present invention that the invention can be readily adapted to situations in which the high-voltage conductors of the switching installation are differently spaced from each other. By simply rotating the aforesaid remaining portion of each high voltage transformer about the longitudinal axis of its respective bushing, the different conductor spacings can be accommodated without the need to offset the high-voltage conductors.

Although an inductive voltage transformer is already known in which the bushing thereof is arranged parallel to the longitudinal axis of the high-potential winding, this known inductive voltage transformer is part of a combined current and voltage transformer for conventional applications and not for metal-encapsulated high-voltage switching installations. In the known voltage transformer, the lateral arrangement of the bushing is chosen in order to obtain a combined measuring transformer which employs as little space as possible by arranging a current transformer above the active parts of the voltage transformer. The required space is, therefore, reduced by arranging the current transformer and the voltage transformer on top of each other.

Also known is a voltage transformer having a bushing attached on the side of the transformer. This arrangement of the bushing, however, is not made to conserve space, but to achieve high electrical and mechanical strength.

To achieve maximum mechanical strength in the arrangement of the present invention, it is advantageous to mount the voltage transformers on a single mounting plate which is adapted to sealingly engage the portion of the metal capsule, thereby sealing same from the remaining parts of the encapsulation. In doing so, disturbances in the insulation of the remaining portions of the metal capsule are prevented from affecting the inductive voltage transformers. In addition, no pressure tank is required for the voltage transformers.

In order to obtain a seal in the region of the bushings of the inductive voltage transformers, it is also considered advantageous to provide the bushings with mounting flanges which are fastened to the mounting plate after the interposition of gaskets between the plate and flanges.

In the embodiment of the invention to be disclosed hereinafter, the high-potential winding in each voltage transformer comprises several serially connected subwindings. These subwindings surround an iron core at respective spacings which increase in steps with voltage. Additionally, each voltage transformer is further provided with a number of control electrodes in the form of conducting cylinders. These cylinders are disposed concentrically with the longitudinal axis of their respective bushing, thereby permitting control of the bushing at both its ends. Also, in this embodiment, the high-potential winding of each transformer is arranged adjacent one side of its respective bushing and extends over the control length thereof. Finally, the subwindings of the transformers are metallically connected to the respective conducting cylinders in such a manner that uniform voltage distribution is obtained if the subwindings are stressed by a surge voltage.

An advantage of the aforesaid embodiment of the invention is that by incorporating part of the bushing of each transformer into the insulation of the high-potential winding of that transformer, each transformer requires a relatively small amount of space in the direction of the longitudinal axis of its respective high-potential winding and, therefore, in the direction of the longitudinal axis of the metal capsule. In addition, the use of conducting cylinders as control electrodes has the advantage of simplifying the design and, thereby, also the fabrication of the transformers. Furthermore, as above-noted, a uniform surge voltage distribution can be obtained due to the coupling of the subwindings, merely by arranging the individual conducting cylinders in concentric spaced relationship with each other and by appropriately selecting their lengths. A surge voltage is, therefore, distributed in each transformer over the individual subwindings as a function of the capacity distribution defined by the cylinders of that transformer, the latter capacity distribution in turn, being selected so that overstressing of individual subwindings is largely precluded.

Although a voltage transformer is already known in which an insulating body comprises individual coil forms which have cylindrical extensions for forming the transformer bushing, each of the individual coil forms carries a conductive coating on its outside and inside, the latter coatings also being provided on the outside and inside of each of the cylindrical extensions. Disposed on the individual coil forms are serially connected subwindings forming the high-potential winding. In particular, the respective inner winding end of each subwinding is connected to a coating on an associated coil form, which is connected, in turn, to a conducting coating on the coil form of the subwinding of the next-higher voltage, the latter coating being connected to the outer winding end of the subwinding of the next-higher voltage. This known voltage transformer has the disadvantage that its design is complicated and its manufacture is therefore very expensive. In addition, the surge voltage distribution in it is unfavorable, due to the manner in which its conducting coatings are arranged.

In the above-discussed embodiment of the present invention, the voltage transformers are further designed so that the conducting cylinders of each transformer have such spacings from each other in the radial direction and have lengths such that, taking into account the capacities of the subwindings, equal capacities are obtained between the conducting cylinders. As a result, a surge voltage is divided up via the cylinders uniformly over the individual subwindings, whereby the surge voltage stress over the entire high-potential winding is equalized in an almost ideal manner.

It is further advantageous to arrange the subwindings of the high-potential winding of each transformer of the present invention so that their outer winding layers touch their respective cylinders on the outside. For design and production reasons, it is also considered advantageous if the high-potential windings of the voltage transformers of the invention are arranged in an insulating body which forms one plastic casting with the bushings. On the other hand, in some cases it may be advantageous for design and/or production reasons if the bushing of each transformer is manufactured by itself and is cast-in with an insulating body designed as a casting and containing the high-potential winding or joined to the insulating body mechanically and electrically in some other manner.

To achieve maximum dielectric surge voltage strength of the voltage transformers of the present invention, it is also advantageous to form the inner winding layer of the subwindings of each of the high-potential windings as a turn of flat ribbon which has a width corresponding to the width of the winding. Additionally, the last turn at the outer end of each subwinding can be designed similarly. It is considered particularly advantageous, if each flat ribbon comprises wire fabric which is surrounded by an impregnable insulating material, e.g., an electrolyte paper.

BRIEF DESCRIPTION OF THE DRAWINGS

The above and other features and aspects of the present invention will become more apparent upon reading the following detailed description in conjunction with the accompanying drawings, in which:

FIG. 1 shows a top view of an arrangement in accordance with the principles of the present invention;

FIG. 4 shows a cross section through a subwinding of the arrangement of FIG. 1.

DETAILED DESCRIPTION

Figure 2:
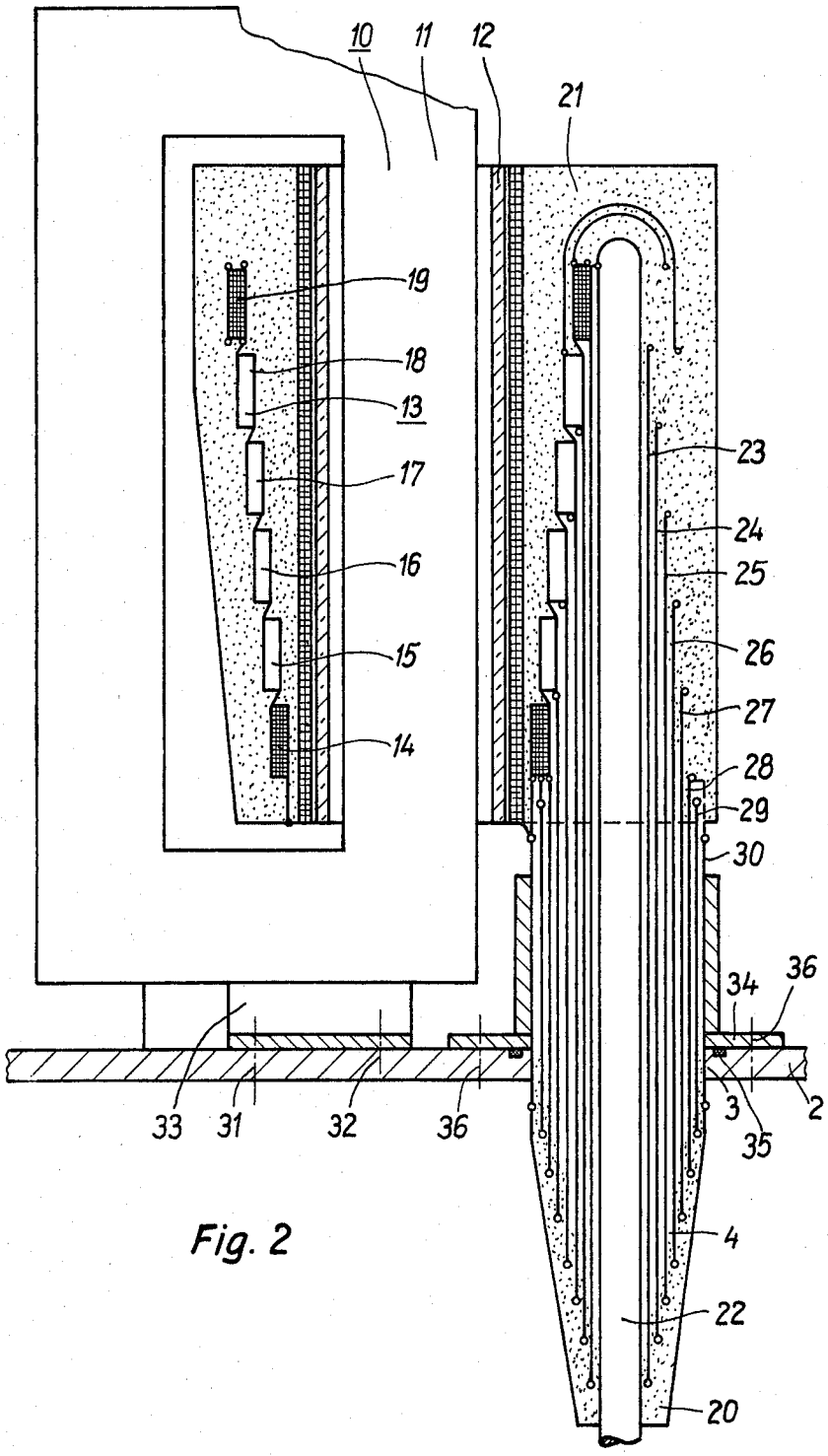
FIG. 2 shows a cross-section through one of the inductive voltage transformers of the arrangement of FIG. 1.

FIG. 1 shows a cylinder portion 1 of a metal capsule of a high-voltage switching installation. The cylindrical portion 1 is separated from the remaining portions of the metal capsule by a mounting plate 2, which is adapted to sealingly engage the cylindrical portion.

The mounting plate 2 is provided with passage holes 3 through which extend the bushings 4, 5 and 6 of the similarly configured voltage transformers 7, 8 and 9. As seen from the cross section of the transformer 7 in FIG. 2, each of the voltage transformers 7 through 9 is equipped with an iron core 10 in the form of a frame core whose leg 11 is surrounded in spaced relationship by a secondary winding 12 and a high-potential winding 13. The high-potential winding 13 comprises a plurality of subwindings 14, 15, 16, 17, 18 and 19, of which the subwinding 14 on the low-voltage side is spaced from the leg 11 by the smallest amount. The further subwindings 15 to 19 are arranged about the leg 11 in steps of increasingly larger spacing as seen from the high-voltage end 20 of the bushing 4, the subwinding 19 therefore being spaced from leg 11 by the largest amount.

The high-potential winding 13 comprised of the subwindings 14 to 19 is embedded in an insulating body 21 which is, preferably, formed of cast resin and which also includes the laterally spaced bushing 4 of the transformer. The high-voltage lead conductor 22 of the bushing 4 is, thus, also embedded in the insulating body 21, as are the control electrodes 23, 24, 25, 26, 27, 28, 29 and 30 formed by control cylinders arranged concentrically around the conductor 22. The subwindings 14 through 19 are connected to the control electrodes 23 through 29 in such a manner that the low-voltage subwinding 14 is connected metallically to the low-voltage control electrodes 29 and the further windings 15 through 19 to the control electrodes 28 to 23 of corresponding potential. The aforesaid connection of the subwindings 14 to 19 to the control electrodes 23 to 29 uniformly distributes surge voltage over the subwindings 14 to 19, whereby damage to the subwindings is avoided.

In order to improve the surge voltage control of the subwindings still further, the first and last layers of the subwindings can be provided with wire fabric wrapped in an electrolyte paper. Advantageously, the fabric should have a width corresponding to the width of the coil.

As may further be seen in FIG. 2, inductive voltage transformer 7 is mounted on the mounting plate 2 via a mounting bracket 33, the latter being screwed into the plate 2 via screws 31 and 32. In order to separate the cylindrical portion 1 which houses the conductive voltage transformer 7 in a gastight manner from the remaining space of the metal capsule, which space in FIG. 2 is located below the mounting plate, the bushing 4 is equipped with a mounting flange 34. This flange is fastened to the mounting plate 2 by means of screws 36 after the interposition of a gasket 35. As above-noted at its outer rim, the mounting plate 2 is adapted to be sealingly joined to the cylindrical portion 1 or to the metal capsule as, for example, by means of welding.

As can be seen in FIG. 1, the inductive voltage transformers 7 through 9 designed as explained above, are arranged on the mounting plate 2 in such a manner that when housed within the portion 1 their bushings 4 to 6 extend into the continuations of the high-voltage conductors 37, 38 and 39, the latter conductors being illustrated by broken lines in FIG. 1. The remaining portions of the inductive voltage transformers 7 through 9, i.e., the portions of each comprising the plastic insulating body 21, the high-potential winding 13, the iron core 10 and the secondary winding 12, are arranged in such a manner that they leave the respective space between the high-voltage conductors 37, 38 and 39 and thus, the bushings 4 to 6 and the cylindrical portion 1 substantially free. More particularly, such remaining portion of each transformer is arranged in a space defined in the circumferential direction by adjacent bushings and the area therebetween which lies adjacent the portion 1 when the transformer is housed therein. Thus, as shown, the remaining portion of the transformer 7 is disposed in the space defined by the bushings 4 and 6 as well as by the area therebetween adjoining the portion 1. The remaining portion of the transformer 8, in turn, is disposed in the space determined by the bushings 6 and 5 and by the area therebetween adjacent the portion 1. Finally, the remaining portion of the transformer 8 is disposed in the space defined by the bushings 5 and 4 as well as by the area therebetween adjacent the cylindrical portion 1.

The inductive voltage transformers 7 to 9, therefore, have, when viewed from their tops an elongated shape which makes it possible to arrange essential parts of the transformers in the space between two bushings and, thus, two high-voltage conductors, so that the relatively scarce space between the high-voltage conductors and the cylindrical portion 1 is not fully occupied.

The invention, of course, does not preclude that under special circumstances, e.g., in the case of very high voltages and inductive voltage transformers whose insulation must be designed accordingly, that the cylindrical portion 1 be enlarged, if necessary, at individual points in order to accept the remaining portions of the inductive voltage transformers. These enlargements of the portion 1 may take the form of caps that are welded to holes at the circumference of the cylindrical portion 1, into which the portions of the inductive voltage transformers which are farthest removed from their respective bushings can protrude. In such case, again only relatively little space is required to accommodate the transformers.

Figure 3:
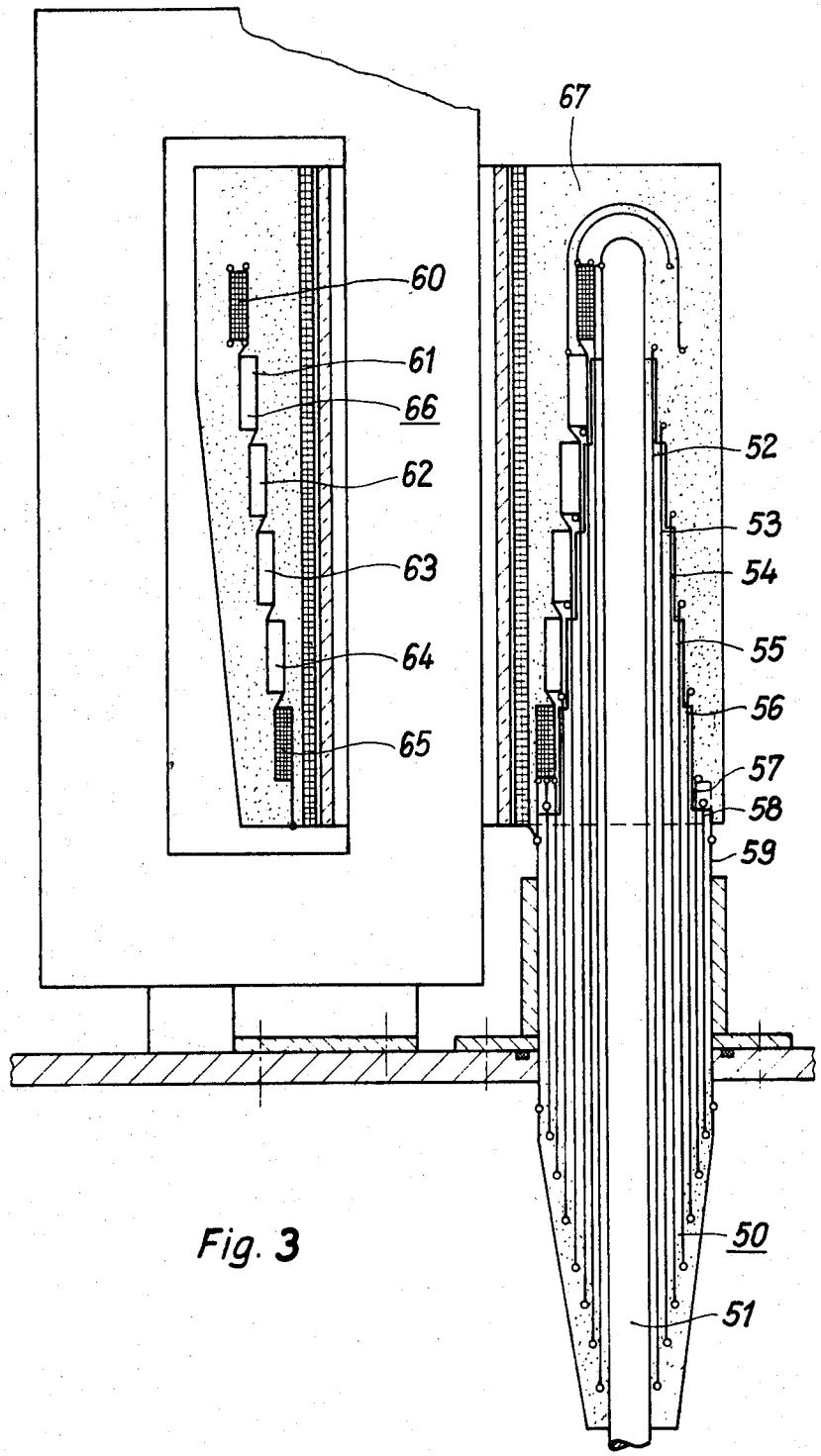
FIG. 3 illustrates a cross section through a second embodiment of an inductive voltage transformer which can be employed in the arrangement of FIG. 1.

FIG. 3 shows a second embodiment of a transformer for use in the arrangement of the invention. This embodiment differs from that FIG. 2 in that the transformer bushing 50, with its embedded high-voltage conductor 51 and conducting cylinders 52, 53, 54, 55, 56, 57, 58 and 59, is manufactured separately, for instance, as a casting of casting resin. Subwindings 60, 61, 62, 63, 64 and 65 of a high-potential winding 66 on the other hand, are carried in a further insulating body 67 which is also in the form of a casting. The insulating body 67 can be formed with the bushing 50 cast-in, but can also be manufactured by itself and then joined to the bushing 50 by additional casting or by means of mechanical connecting elements.

FIG. 4 shows a subwinding 70 which can be used as the subwindings of the high-potential windings of the transformers of the invention. The winding 70 is constructed as a cylindrical coil and contains a number of turns 71 formed of normal, round coil wire. The last turn 72 of the subwinding 70 is formed by a flat ribbon, the width of which corresponds to the width of the subwinding 70. As shown, the flat ribbon comprises a wire fabric 73 which is surrounded by impregnable insulating material 74.

What is claimed is:

1. A transformer arrangement comprising:

a plurality of inductive voltage transformers within a metal capsule, each of which comprises:

an insulating body having a high potential winding disposed therein;

and a bushing laterally joined to said insulating body;

the bushing of each of said voltage transformers having a high voltage conductor therein; said bushings extending through said capsule in a substantially parallel arrangement;

and the remaining portion including the insulating body of each one of said voltage transformers being arranged in a space defined by the bushing corresponding to that one transformer, the bushing following said corresponding bushing in the circumferential direction and included in the voltage transformer adjacent said one voltage transformer, and by the area between said corresponding and following bushings which lies adjacent said capsule.

2. An arrangement in accordance with claim 1 which further comprises:

a mounting plate upon which said voltage transformers are mounted, said plate sealingly engaging said capsule.

3. An arrangement in accordance with claim 2 wherein:

each of said bushings includes a mounting flange which is fastened to said plate;

and said arrangement further includes a plurality of gaskets, each of which is disposed between the mounting plate and the mounting flange of a different one of said bushings.

4. An arrangement in accordance with claim 1 wherein:

each one of said voltage transformers further includes:

an iron core;

and a number of control electrodes disposed concentrically with the longitudinal axis of the bushing of that one transformer, thereby providing control of both ends thereof;

the high potential winding of each of said voltage transformers being arranged adjacent to and so as to extend over the control length of one side of the bushing thereof;

and the high potential winding of each one of said voltage transformers comprising a number of serially connected subwindings surrounding the iron core of that one voltage transformer so as to be spaced therefrom at increasing steps with voltage, said subwindings being metallically connected to the control electrodes of that one voltage transformer such that a uniform voltage distribution is obtained when said subwindings are stressed by a surge voltage.

5. An arrangement in accordance with claim 4 in which:

the control electrodes of each of said voltage transformers are spaced from each other in the radial direction and are of such lengths that the capacities between the electrodes including the capacities of the corresponding subwindings are equal.

6. An arrangement in accordance with claim 5 in which:

the subwindings of each of said voltage transformers are arranged so that their outer winding layers are in contact with respective control electrodes of that voltage transformer.

7. An arrangement in accordance with claim 4 in which:

the insulating body and the bushing of each voltage transformer are in the form of a single plastic casting.

8. An arrangement in accordance with claim 4 in which:

the bushing of each voltage transformer is a separate component from the insulating body of that voltage transformer;

and the insulating body of each voltage transformer is a casting into which the bushing of that voltage transformer is cast.

9. An arrangement in accordance with claim 4 in which:

the bushing of each voltage transformer is a separate component which is mechanically and electrically joined to the insulating body of that voltage transformer.

10. An arrangement in accordance with claim 4 in which:

the inner winding layer of each subwinding of each of said voltage transformers comprises a turn of flat ribbon whose width corresponds to the width of the subwinding.

11. An arrangement in accordance with claim 4 in which:

each last turn at the outer winding end of each of the subwindings of each of said voltage transformers comprises a flat ribbon whose width corresponds to the width of the subwinding.

12. An arrangement in accordance with claim 10 in which each of said flat ribbons comprises a wire fabric surrounded by an impregnable insulating material.

13. An arrangement in accordance with claim 11 in which each of said flat ribbons comprises wire fabric surrounded by an impregnable insulating material.

* * * * *